US008313366B2

(12) United States Patent
Sparago

(10) Patent No.: US 8,313,366 B2
(45) **Date of Patent: *Nov. 20, 2012**

(54) CARD GAME

(75) Inventor: Merrill Sparago, Los Angeles, CA (US)

(73) Assignee: Score Gaming LLC, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/433,466

(22) Filed: Mar. 29, 2012

(65) Prior Publication Data

US 2012/0196665 A1 Aug. 2, 2012

Related U.S. Application Data

(63) Continuation of application No. 12/603,713, filed on Oct. 22, 2009.

(60) Provisional application No. 61/114,613, filed on Nov. 14, 2008.

(51) Int. Cl.
*A63F 1/00* (2006.01)

(52) U.S. Cl. ..... 463/13; 273/292; 273/274

(58) Field of Classification Search ..... 273/292, 273/274, 309; 463/13, 12
See application file for complete search history.

(56) References Cited

U.S. PATENT DOCUMENTS 5,324,041 A 6/1994 Boylan et al.
5,377,993 A 1/1995 Josephs
5,494,295 A 2/1996 Potter et al.
5,685,774 A 11/1997 Webb
5,873,571 A 2/1999 Vaisman et al.
5,921,550 A 7/1999 Awada
5,988,643 A 11/1999 Awada
6,220,597 B1 4/2001 Scibetta
6,237,916 B1 5/2001 Webb
6,402,148 B1 6/2002 Saruwatari
6,409,174 B1 6/2002 Demarest
6,481,717 B1 11/2002 Richardelle
6,585,588 B2 7/2003 Hartl
6,626,433 B2 9/2003 Scibetta
6,789,801 B2 9/2004 Snow
6,869,075 B1 3/2005 Stavinsky
7,059,965 B2 6/2006 Jackson
7,168,705 B2 1/2007 Scibetta
7,331,580 B2 2/2008 Scibetta
2002/0113371 A1 8/2002 Snow
2006/0027967 A1 2/2006 Chen
2007/0155462 A1 7/2007 O'Halloran et al.

*Primary Examiner* — Benjamin Layno
(74) *Attorney, Agent, or Firm* — Endurance Law Group PLC

(57) ABSTRACT

A card game played on an electronic gaming machine between a game machine/dealer and one or more players. Each player is dealt one card. Three community cards (Flop cards) are dealt and, in succession, compared to each player's card according to the rules of War. A fourth community card (Turn card) is revealed, along with a single dealer card. The player's final hand must outrank the dealer's final hand and achieve at least a preset Poker ranking in order to win a mandatory wager. A second Raise portion of the player's wager is won if the player's card combined with the four community cards form a predetermined poker hand ranking. In a variation of the game method, one Bet the Hole wager is resolved according to the rules of War.

20 Claims, 8 Drawing Sheets

POKER
HAND RANKINGS

| | | | | | |
|---|---|---|---|---|---|
| Royal Flush | 10♥ | J♥ | Q♥ | K♥ | A♥ |
| Straight Flush | 4♣ | 5♣ | 6♣ | 7♣ | 8♣ |
| Four of a Kind | K♠ | K♥ | K♣ | K♦ | 3♠ |
| Full House | 10♥ | 10♠ | 10♦ | A♠ | A♣ |
| Flush | 10♠ | K♠ | 2♠ | 6♠ | 7♠ |
| Straight | 7♣ | 8♠ | 9♦ | 10♠ | J♥ |
| Three of a Kind | 5♠ | 5♥ | 5♣ | J♦ | A♦ |
| Two Pair | A♠ | A♥ | 3♣ | 3♠ | J♣ |
| One Pair | Q♦ | Q♥ | 2♥ | 8♠ | 9♣ |

FIG. 1

"THE DEAL"

Dealer's Hole Card
Community Cards
Flop Cards
Turn Card
Player #1 Card
Player #2 Card
Player #3 Card
Optional Bets
1
2
3
Mandatory Bet
M

ROUND 1 (WAR)

ROUND 2 (WAR)

ROUND 3 (WAR)

ROUND 4 (POKER)

CARD GAME

CROSS REFERENCE TO RELATED APPLICATIONS

This application claims priority to U.S. patent application Ser. No. 12/603,713, filed Oct. 22, 2009, which claims priority Provisional Patent Application No. 61/114,613 filed Nov. 14, 2008, the entire disclosures of which are hereby incorporated by reference and relied upon.

BACKGROUND OF THE INVENTION

1. Field of the Invention

The present invention is directed to games involving playing cards, and more particularly, wagering games played on casino-operated tables and via electronic game terminals combining elements of the traditional games of Poker and War.

2. Related Art

Poker and War are both popular card games which are usually played separately. Most casinos already offer these two games or variations thereof in electronic format and/or as live table games.

War is commonly played by dealing a single card to two respective hands, such as a player and a dealer hand, and then comparing the rank of the single card in each hand. The winner is the hand with the highest ranked card. Ties spawn multi-card challenges. Poker is probably the most well-known game in the United States and has many different variations. Some variations may be played with a total of five cards in a hand. Typically, after all cards are revealed, the player with the highest ranked Poker hand is the winner.

U.S. Pat. No. 7,331,580 to Scibetta teaches a variety of card games based on War. In one embodiment, each player is dealt five cards. The dealer receives one card. War is played with each player card being compared to the dealer card so that five separate games of War are played for each player. Then, the five player cards are compared to a Poker ranked table for a possible bonus win.

U.S. Pat. No. 6,402,148 to Saruwatari teaches a game in which six player positions are dealt one card each and a dealer is dealt one card. The six player cards are dealt whether or not a person is playing that position. Each player resolves a first War game against the dealer by comparing their one dealt card to the dealer card. Following the game of War, all six player cards, together with the dealer card, are considered community cards for purposes of resolving a second wager in which the rules of Poker are applied. All of the players either win or lose as a group.

U.S. Pat. No. 5,324,041 to Boylan et al. discloses a War-like card game with a suggested Poker variation.

U.S. Pat. No. 5,988,643 to Awada teaches a multi-player game in which a first card dealt to each player and a dealer are used to resolve a game of War, followed by additional cards dealt to each player to resolve a second wager based on the rules of Blackjack. The collection of dealt cards to each player are assessed for a Poker hand, from which a third and final wager is resolved.

The preceding examples of card games propose methods of play in which some combination of War and Poker are played. However, none of these games effectively utilize a set of community cards from which the players and dealer alike fashion a Poker hand. The use of community cards in some card games, like Texas Hold'Em Poker for example, has added a social element to some card games, and has been found to increase the joy and excitement of certain card games. Casinos are continually seeking ways in which they can increase their gaming revenue. Thus, there is a compelling interest in creating new games that are likely to increase player participation and wagering. Poker and War are two games with a proven record of success. What is needed is a unique combination of these traditional card games together with the addition of some of the appealing features of community cards and structured in ways to generate immediate, favorable interest amongst players.

SUMMARY OF THE INVENTION

This invention relates to a method for playing a card game combining elements of the traditional games of Poker and War between the dealer and at least one player. At least one standard deck of 52 playing cards is provided, the cards being arranged in the traditional manner. Each player is dealt one card from the deck to form a single player card, also known as a partial player hand. The dealer is likewise dealt one card from the deck to form a dealer card, or partial dealer hand. First, second, third and fourth community cards are dealt to the playing surface. These cards are all, preferably, dealt face down. At least one, and up to four separate wagers are then received from each player. A first portion of each player's wager is resolved in favor of the dealer if the rank of the first community card is found to be greater than the rank of the player card, and conversely in favor of the player if the rank of the first community card is less than the rank of the player card. A second portion of the wager is resolved in like manner comparing the ranks of the second community card with each player card. A third portion of the wager is resolved in like manner by comparing the rank of the third community card with the rank of the player card. In this manner, the first, second and third portions of the wager are resolved, sequentially, using the traditional rules of the game of War. A fourth portion of the wager is resolved in favor of the dealer if the dealer card combined with the four community cards form a better hand than formed with the player card combined with the four community cards according to the traditional rules of Poker. Conversely, the fourth portion of the wager is resolved in favor of the player if the player card combined with the four community cards form a better hand than formed with the dealer card combined with the four community cards according to the traditional rules of Poker.

In this manner, one or more players can oppose a dealer and individually resolve up to four separate wagers, three of which use the traditional rules of War and a fourth of which is resolved according to the traditional rules of Poker. The four community cards are used by both dealer and players to resolve all of the wagers, however the dealer's card (i.e., partial dealer hand) is only used to resolve the fourth portion of the wager under the traditional rules of Poker.

Preferably, the game is played as a live table game, however automated dealer and video game applications are possible. Players have the option of placing between one and four wagers. The first three (optional) wagers are resolved using the rules of War, whereas the final (mandatory) wager is resolved using the rules of Poker.

Various options are possible, including opportunities to forfeit a portion of the mandatory Poker wager upon viewing one or more of the community cards, as well as the opportunity to raise bets at defined points in the game. This invention combines the well-known and broadly accepted rules of Poker and War into a single, fast paced, appealing game which is easily learned by players at any level. The use of community cards adds a social dimension to the game which increases enjoyment. Accordingly, a game of this nature will be readily accepted by casinos and other gambling establishments, as well as played in electronic environments in standalone electronic gaming devices as well as via internet delivered gaming systems.

BRIEF DESCRIPTION OF THE DRAWINGS

These and other features and advantages of the present invention will become more readily appreciated when considered in connection with the following detailed description and appended drawings, wherein:

FIG. 1 is a table providing an exemplary depiction of winning hands ranked according the traditional rules of Poker;

DETAILED DESCRIPTION OF THE PREFERRED EMBODIMENT

The present invention is directed to a system and method of playing a wagering game which includes a plurality of wagering opportunities and payouts based on satisfying preset criteria, and may have more than one round in which a player receives a player's hand of one or more cards which will be used to determine an outcome in each round of the game.

Figure 2:
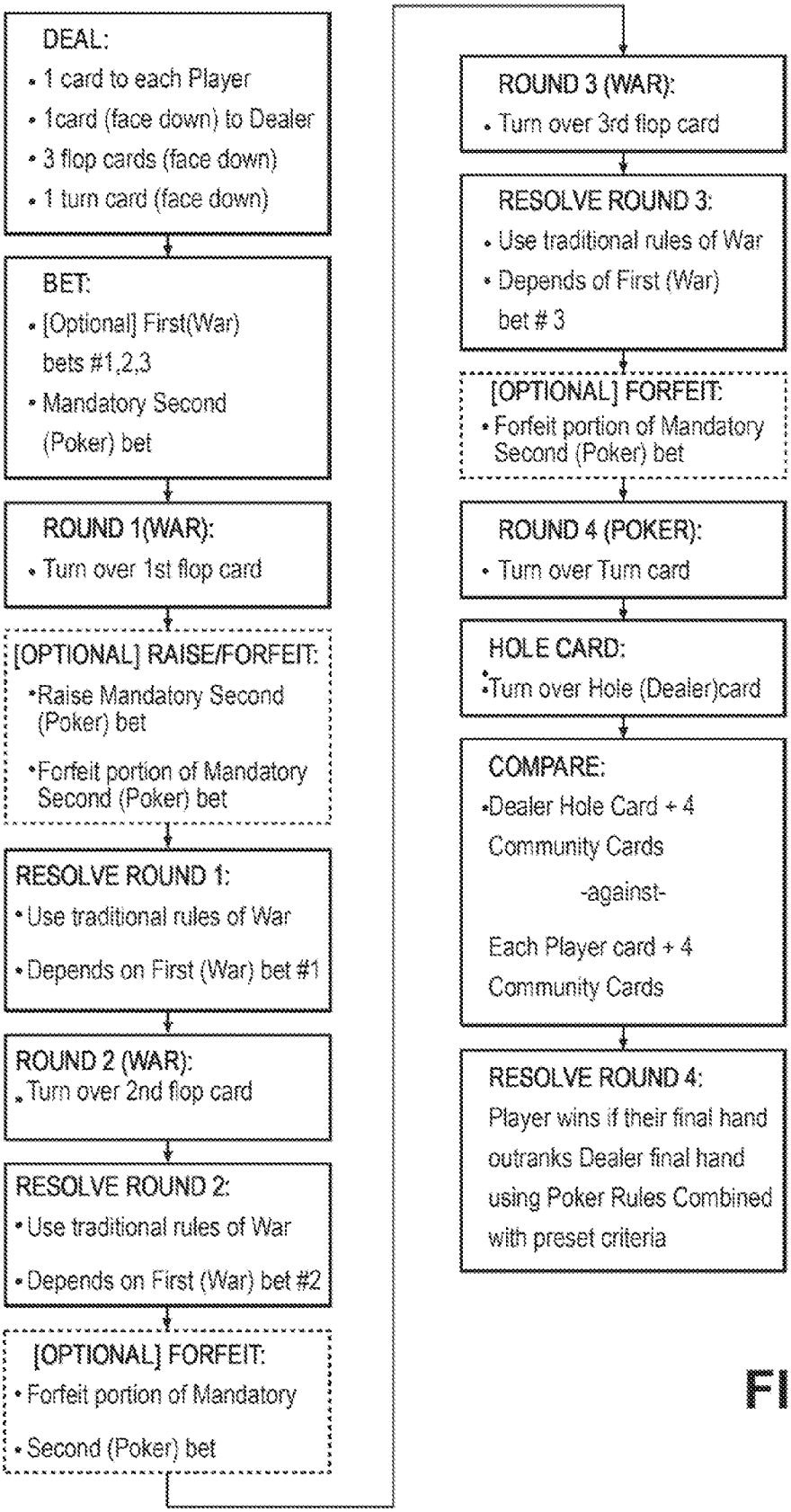
FIG. 2 is a flow chart describing one exemplary embodiment of the method of this invention.
Figure 3:
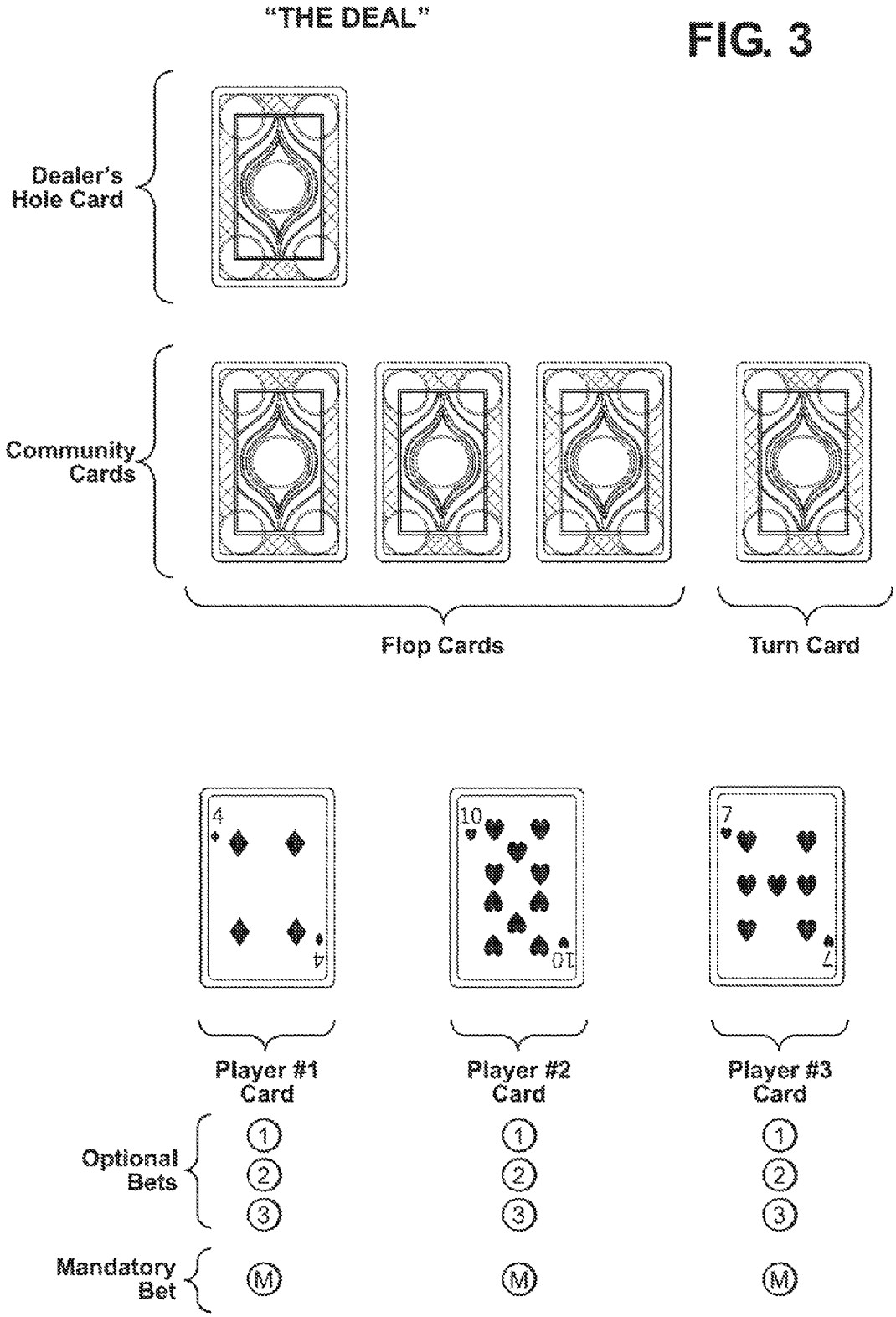
FIG. 3 depicts and exemplary game of play in which three players simultaneously oppose a common dealer, illustrating an initial deal in which the dealer card and four community cards are presented face down and each player card is laid face up on the playing surface.

The present invention is also directed to a method of playing a wagering card game, as shown diagrammatically in FIG. 2. The method of this card game includes in general the steps of: Deal; Bet; Round 1 (War); Round 2 (War); Round 3 (War); and Round 4 (Poker), together with interspersed optional raise/forfeit opportunities and such other variations as may be apparent to those of skill in this field. The game utilizes at least one standard deck of 52 playing cards arranged in the traditional manner with faces designated (in ascending rank) 2-10, J, Q, K, A each in four suits. Each player is dealt one card from the deck, and likewise the dealer is dealt one card from the deck. First, second, third and fourth community cards are dealt either before or after receiving a wager from each player. (The wager may be further divided among separate bets as described below). During the so-called Round 1, a first portion of the wager is resolved in favor of the dealer if the rank of the first community card is greater than the rank of the player card, but alternatively in favor of the player if the rank of the first community card is less than the rank of the player card. If the rank of the first community card is equal to the rank of the player card, the first portion of the wager may be resolved in favor of neither, i.e., result in a push.

During the so-called Round 2, a second portion of the wager is resolved in favor of the dealer if the rank of the second community card is greater than the rank of the player card, but alternatively in favor of the player if the rank of the second community card is less than the rank of the player card, and in favor of neither if the rank of the second community card is equal to the rank of the player card. During the so-called Round 3, a third portion of the wager is resolved in favor of the dealer if the rank of the third community card is greater than the rank of the player card, but alternatively in favor of the player if the rank of the third community card is less than the rank of the player card, and in favor of neither if the rank of the third community card is equal to the rank of the player card. During the so-called Round 4, a fourth portion of the wager is resolved in favor of the dealer if the dealer card combined with the four community cards form a better hand than formed with the player card combined with the four community cards according to the traditional rules of Poker, but alternatively in favor of the player if the player card combined with the four community cards form a better hand than formed with the dealer card combined with the four community cards according to the traditional rules of Poker.

Stated another way, the method may be described as the steps of: receiving a first wager from a player; receiving a second wager from a player; dealing cards to form a player's partial hand, a dealer's partial hand and at least one community card; comparing the rank of the player's partial hand to the rank of the at least one community card using a first preset ranking order, wherein the player wins the first wager if the player's partial hand outranks the at least one community card and loses the first wager if the at least one community card outranks the player's partial hand; and comparing the rank of a player's final hand to the rank of a dealer's final hand using a second preset ranking order, wherein the player's final hand includes the player's partial hand and the at least one community card and the dealer's final hand includes the dealer's partial hand and the at least one community card, and the player wins the second wager if the player's final hand outranks the dealer's final hand and satisfies a preset criteria. In this latter expression of the invention, the first (War) wager is preferably, but not necessarily, an optional wager consisting of three separate sub-wagers, and the second (Poker) wager is a mandatory wager that must be placed by each player in order to play the game. The wagers may be pre-set (i.e., specified) or variable. In the preferred embodiment, there are four community cards dealt, plus one card dealt to form the player's partial hand, and one card dealt to form the dealer's partial hand. Also, if the optional (first War) wager is placed, the total of the optional wager may be specified as equal to the second (Poker) wager. Thus, if, by example, two (of three possible) optional wagers are placed at $5 each, than the second mandatory wager will be specified at $10. Alternatively, if no optional wagers are placed then the second mandatory wager may be placed at a set or variable rate.

The first preset ranking order for comparing the ranks of the player's partial hand and the community card is similar to the rules of War, in that the highest ranking card wins, excluding card suit. In particular, the ranking order from highest to lowest rank is as follows: Ace, King, Queen, Jack, and then from 10 down to 2, without regard to suit. However, special rules can of course be established by the house such as "threes beat faces; fours beat aces," etc.

Each of the three optional wagers corresponds with one of the community cards and the player's partial hand of one card is compared separately with three of the four community cards to resolve each individual wager. In other words, the player will win one optional wager for each community card that the player's partial hand of one card outranks according to the aforementioned ranking order. In this embodiment, a tie between the player's partial hand and any of the community cards results in a "push," that is, the player's corresponding wager is returned to the player. Thus, contrary to the traditional games of War, ties do not result in a multi-card challenge.

The player's partial hand of one card will be compared with each of the remaining community (Flop) cards except the fourth community (Turn) card.

The second preset ranking order in this embodiment of the invention for comparing the player's final hand with the dealer's final hand is based on conventional Poker rules. The player's final hand will consist of the player's partial hand combined with the four community cards. Likewise, the dealer's final hand will consist of the dealer's partial hand combined with all four community cards. Thus, the Poker rank of each respective hand is determined accordingly. The player's final hand must outrank the dealer's final hand and must also satisfy preset criteria (for example: any pair) to win the mandatory wager. Traditional and standard Poker hand rankings are provided in FIG. 1.

In the preferred embodiment, the preset criteria is a standard Poker ranking, and may include a pay table of Poker rankings and corresponding payouts expressed as multiples of the second or mandatory wager, or payout amounts. The payout multiples or amounts may depend on the overall game odds desired by the house.

Thus, in the preferred embodiment, a player's final hand must outrank the dealer's final hand and achieve at least a preset Poker ranking shown in a pay table in order to win the mandatory wager. The wager will be lost if the player's final hand either is outranked by the dealer's final hand or outranks the dealer's final hand but fails to achieve a ranking shown on the pay table. In the case of a tie between the player's final hand and the dealer's final hand, and the player's final hand satisfies the preset criteria, the wager may be lost, won, or push, depending on the overall game odds desired by the house.

Alternatively, the preset criteria may relate to other factors or conventions, such as a total of the card numerical values. Also, in an alternative embodiment, the player may win a separate payout amount if other outcomes occur. For example, a game of the present invention may provide a payout to a player if the player's final hand outranks the dealer's final hand but does not satisfy the preset, criteria, or if the player's final hand achieves a particular rank according to the preset criteria but is outranked by the dealer's final hand, which is sometimes referred to as a "bad beat" scenario.

In one embodiment, the community cards and dealer's partial hand are dealt face down. Each community card is turned over one at time to resolve each of the three optional wagers. It is envisioned that in one embodiment a player may forfeit a portion of the mandatory wager upon viewing one or more of the community cards. Alternatively, the player may be given the option to forfeit a portion of the mandatory wager upon viewing the fourth community card. In another embodiment, the player may choose to "raise" their bet after the first community card is shown. The raise must be at a preset amount and the player's final hand must qualify at a preset level of Poker rankings to win the bet. In this embodiment the player may win both the first mandatory bet and the optional "raise" bet should the foregoing criteria of a winning hand be met.

Figure 8:
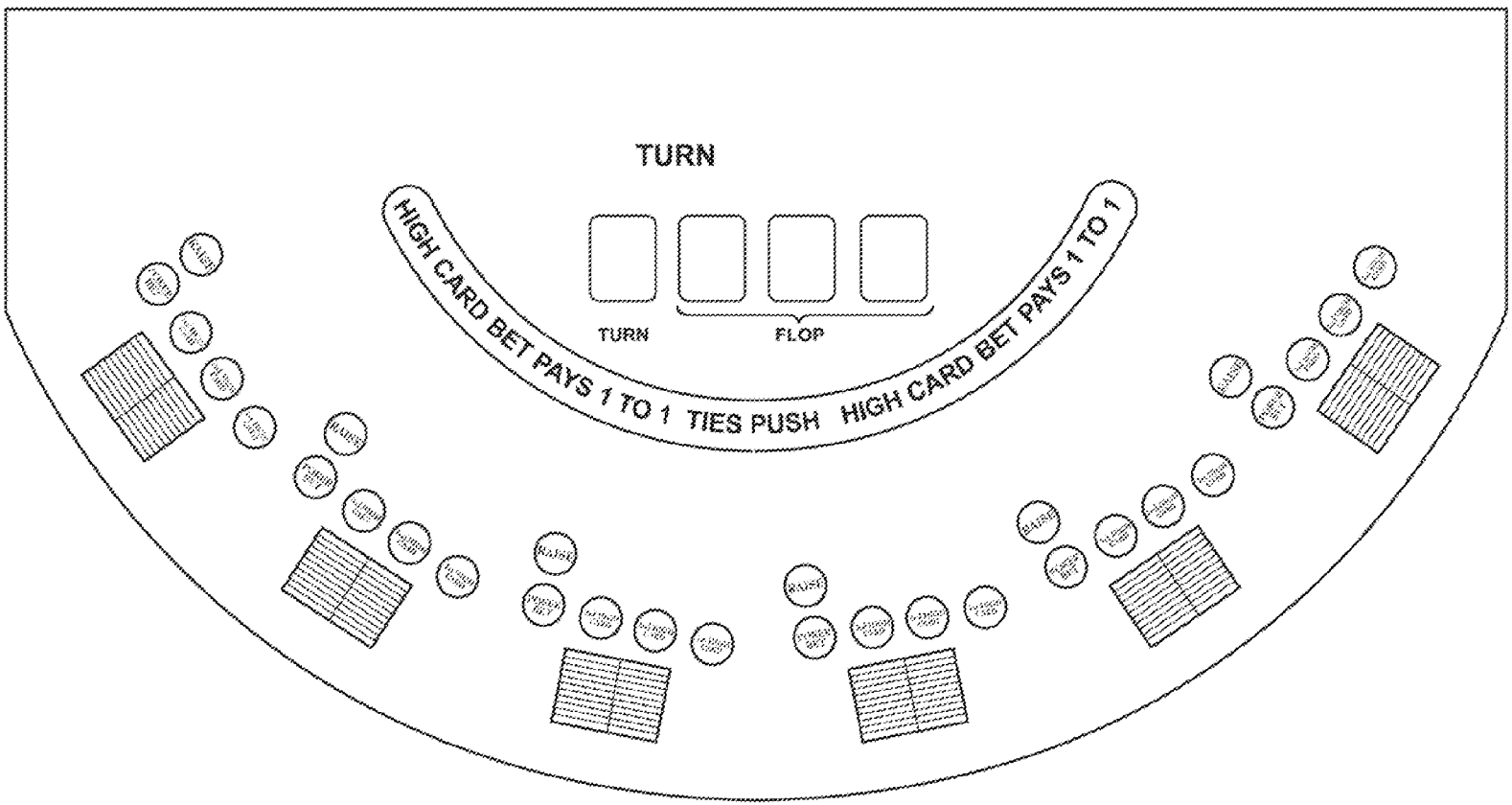
FIG. 8 illustrates a sample table layout as may be used in a casino to play a game according to this invention.

In an exemplary embodiment, the present invention is played as a live table game, such as shown in FIG. 8. The game may be played with a live or automated dealer and from one to six players may participate. The cards are dealt from a single deck or may be dealt from a shoe holding multiple, e.g., six decks, depending on the odds desired. It should be understood that the decks of cards employed in the game and the associated odds may be simulated in a virtual environment, such as via an electronic gaming console or computer terminal.

Players have the option of placing up to four wagers, three first wagers and one second wager. The three first wagers are separate wagers on three individual spots that shall be labeled with a predetermined name. For example, the spot can be named, but not limited to, "High Card" for the optional wager and one on an individual spot named Poker for the mandatory wager. The three may be the same or in different amounts. Players may have the option of betting on one, two or all three of the optional wagers, but must bet on the Poker wager. The Poker wager preferably matches the sum all of the "High Card" wagers. All wagers must be placed prior to the deal.

The dealer distributes one card to each participating player at the table, preferably beginning with the player to the far left of the dealer, to form a respective player's partial hand for each participating player. After the players have been dealt a partial hand, a single card is dealt face down in a designated area to form the dealer's partial hand. This dealer card is also known as the "Hole" card. The dealer deals three cards face down in designated spots on the table labeled "Flop." At this time, one card may be dealt face down in a designated spot labeled "Turn", constituting the four community cards. The Turn card may be dealt with the first three community cards or may be dealt after each of the three flop cards are revealed. In all instances, a traditional "Burn" card, i.e., a card that is dealt unexposed and is not used in play, may be dealt before the Turn card. In a preferred method of game play, the 4th community card (i.e., Turn) is dealt with the initial three flop cards. This completes the distribution of the cards for the play of one round of the game.

Resolving the first wagers begins with the dealer revealing each of the three cards located in the area designated "Flop" one at a time. Each Flop card is compared with the card in each participating player's partial hand to determine an outcome for each wager, that is, whether the respective player's partial hand outranks, ties, or is outranked by, the Flop card. Thus, up to three individual rounds of "War" are played between the player and the dealer as the dealer reveals one "Flop" card at a time and resolves the corresponding wager from each player.

In determining the winner of the "War" hand, the value of the card is based only on the numerical value: two through ten, with Jack, Queen, King, and Ace in ascending rank order making Ace the highest ranking card. Individual suits of cards are not considered in the value of a card for the first preset ranking order of "War" in this embodiment. Should the Flop card and player both have a card of equal value, (e.g., both dealer and player have a Jack), the bet is a push and the player retains their wager relating to that particular outcome. Bonuses may be paid for specific combinations of cards that are drawn between the Flop card and player, such as equally ranked and matched suited cards. For example, if in a multi-deck variation of the game if the first Flop card is a Jack of spades and the player's card is also a Jack of Spades this may pay a bonus to the player.

All winning wagers are preferably paid even money, although they may be paid otherwise, such as a multiple dependent on the relative values of the player's partial hand as compared to the Flop card. Losing wagers are collected and players may retrieve wagers which push on ties according to the house rules.

Figure 4:
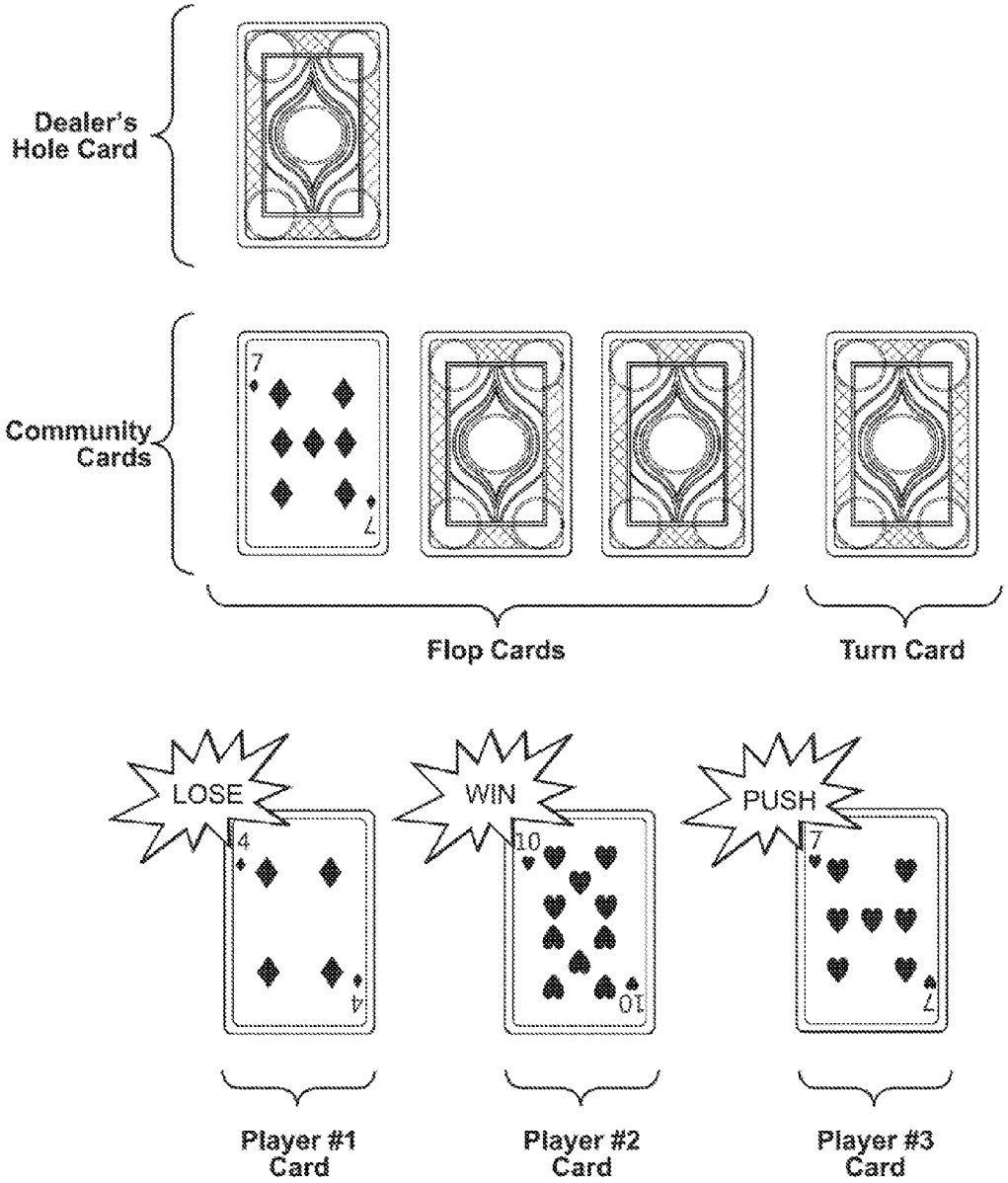
FIG. 4 is a view as in FIG. 3 but depicting a further progression of game play in which the first community (Flop) card has been revealed and a first round of play is resolved according to the rules of War.
Figure 5:
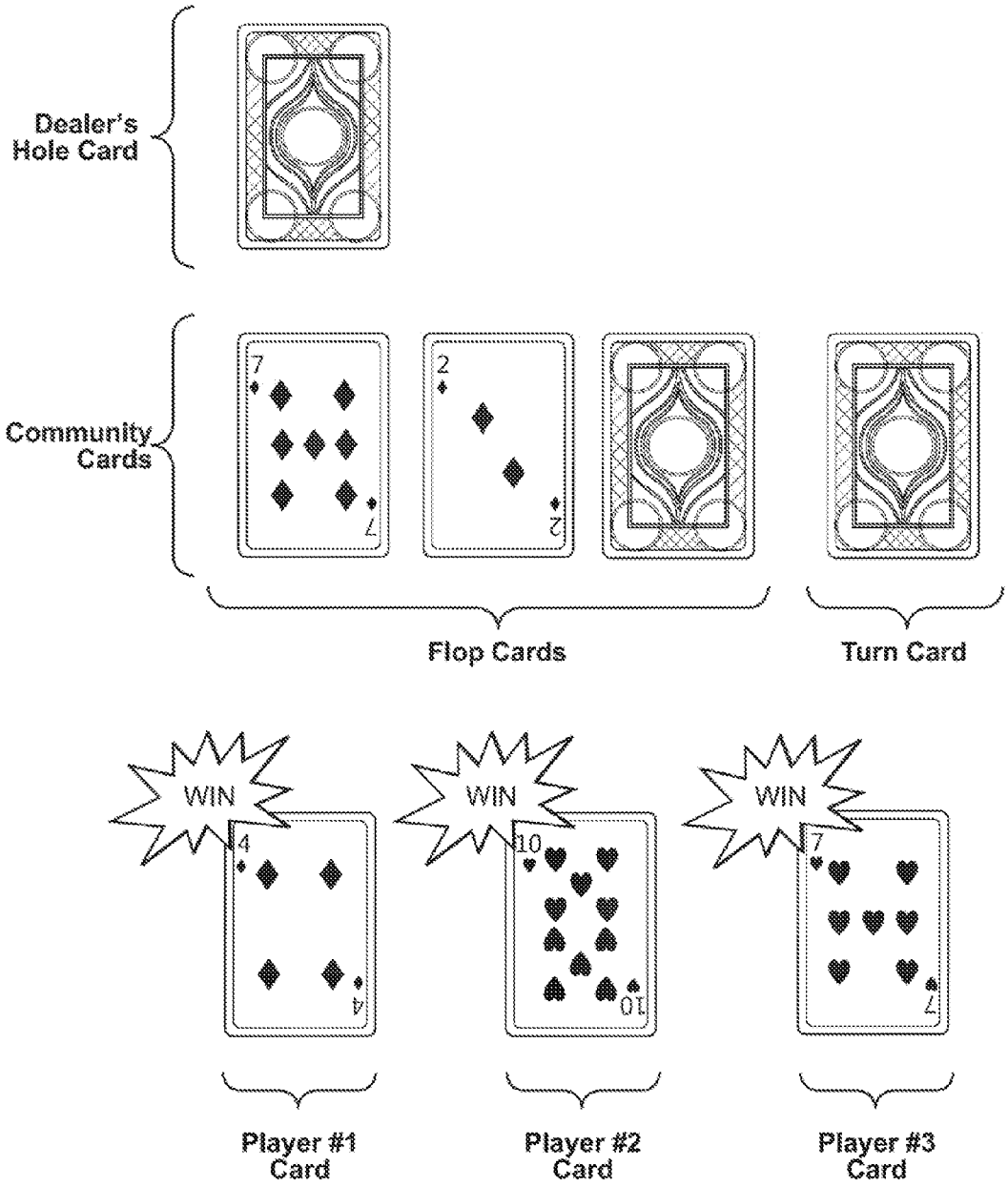
FIG. 5 is a view as in FIG. 4 depicting a second round of play in which the second community (Flop) card is revealed and second wagers are resolved according to the traditional rules of War.
Figure 6:
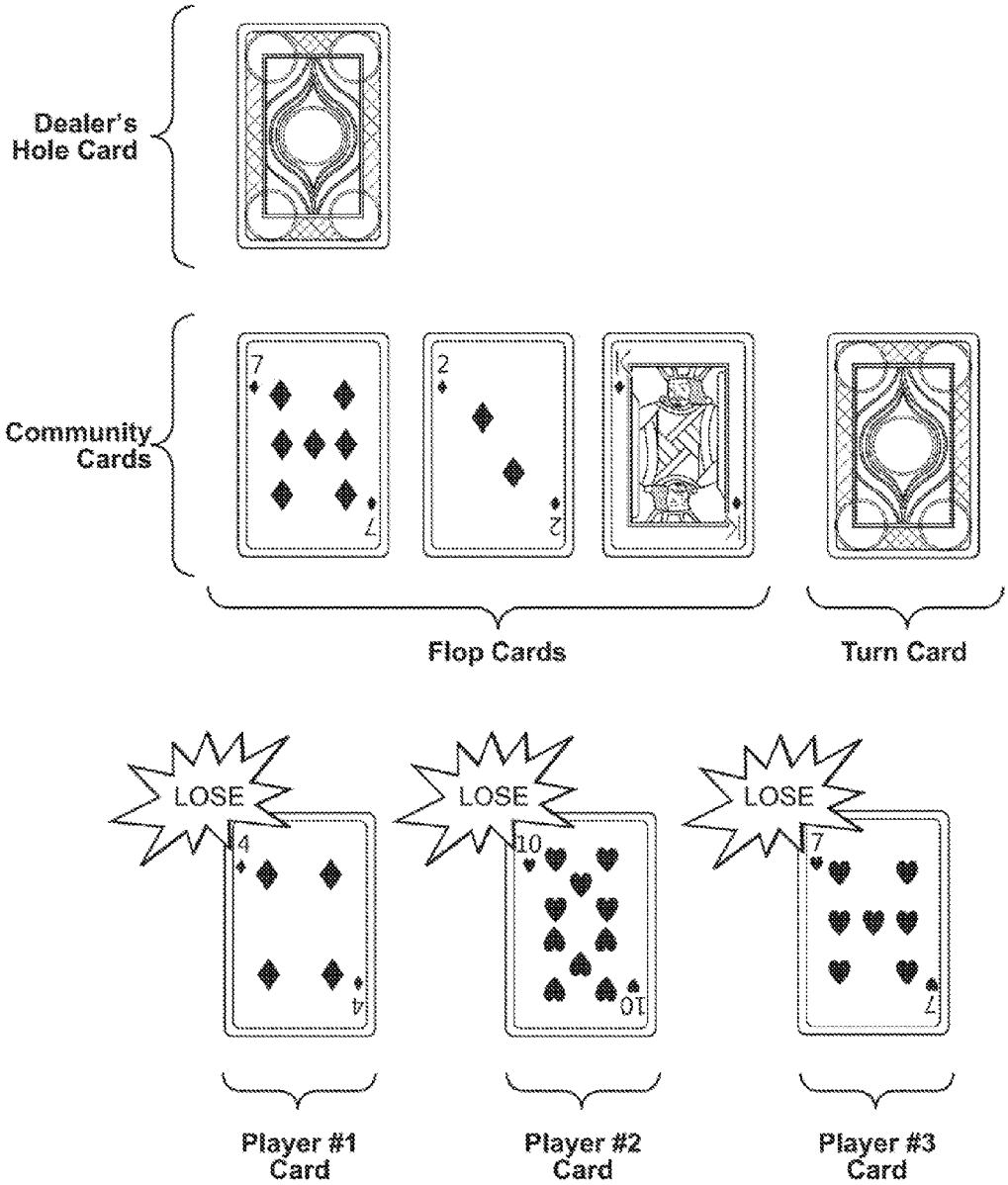
FIG. 6 is a view as in FIG. 5 but depicting a further progression of game play in which the third community (Flop) card is revealed and a third round of play is resolved according to the traditional rules of War.

Referring now to FIGS. 3-7, if for example, player 1 is dealt a four, player 2 is dealt a ten, and player 3 is dealt a seven, and a first Flop card is a seven, then player 1 would lose their wager because seven outranks the player's four, player 2 would win their wager because their ten outranks seven, and player 3 neither win nor lose their wager because their card is of equal value to the Flop card. This resolution of Round 1 (War) is depicted in FIG. 4. The dealer then reveals the next card in the Flop group of cards, as shown in FIG. 5. The next Flop card is then compared to the value of the card in each player's partial hand as shown above. Thus, in the above example, if the dealer now reveals a two as the next Flop card, then all players would win, because each of the cards in their individual partial hands outrank the Flop card. All wagers are paid and collected accordingly. The dealer then reveals the third Flop card as shown in FIG. 6, and the procedure repeats itself for a third and final time (i.e., all player's partial hands are compared to the third revealed community card with wagers paid and collected accordingly). In this example, the third Flop card is a King, and all players lose. Adjustments to the game can be made, such as by limiting the number of War bets placed to speed play.

FIG. 6 represents the completion of the portion of the game which is resolved according to the first preset ranking order. At this point, each player is aware of their respective player's partial hand, and three of the four community cards have been dealt (or revealed, if the turn card was earlier laid face down on the table). In other embodiments, players may choose to forfeit their hands, which would be termed a "Fold" and lose up to 50% of their $4^{th}$ wager as each community card representing the flop cards are revealed. Players may Fold after the first flop card is revealed, after the second flop card is revealed, or after the third flop card is revealed. Players may also be provided with the opportunity to double their Poker wager in other embodiments.

Figure 7:
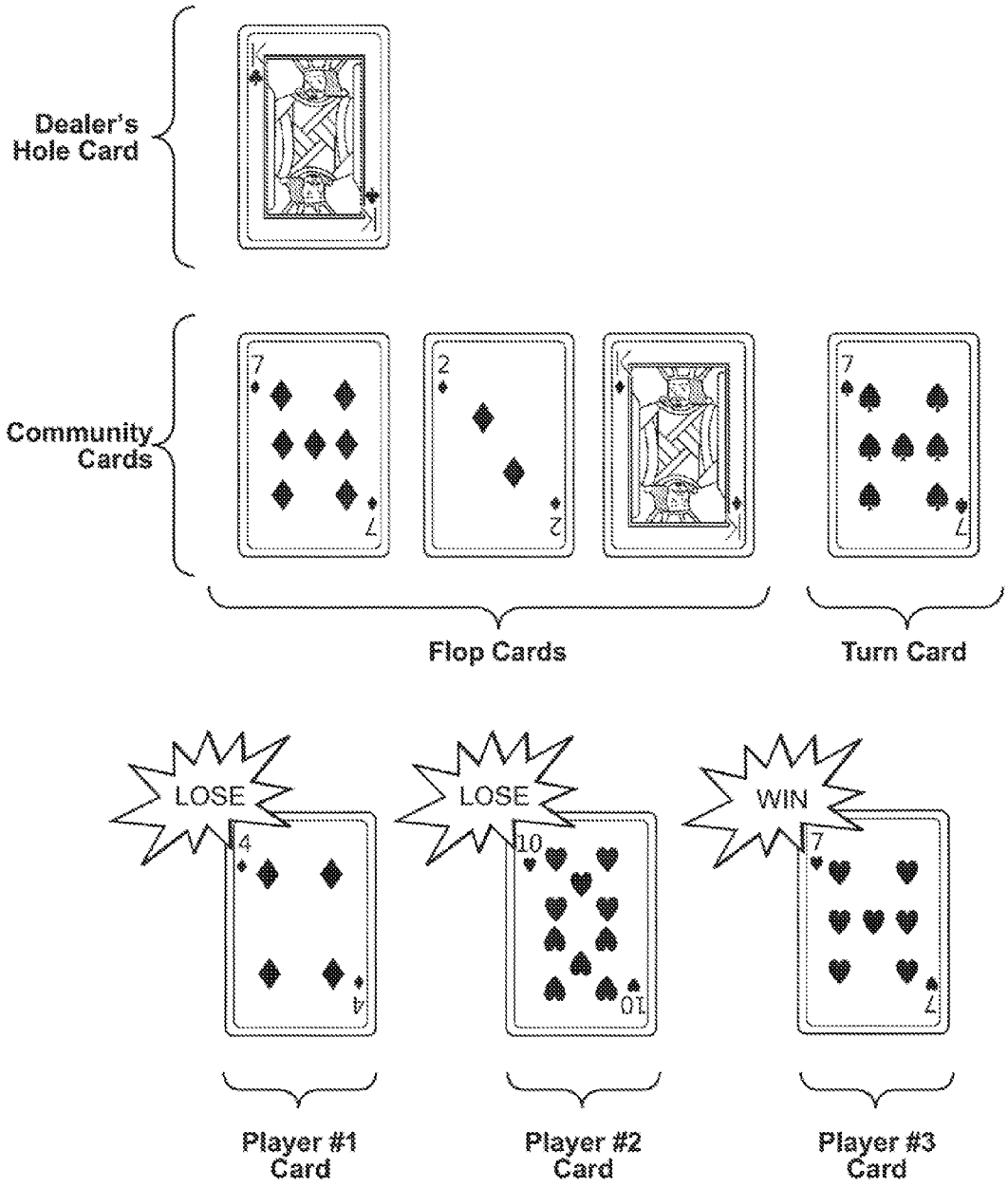
FIG. 7 is a view as in FIG. 6 but depicting a fourth and final round of play wherein the fourth community (Flop) card is revealed and a fourth wager is resolved according to the rules of Poker.

Once all players decide to raise, fold, or stay, the dealer deals (or reveals) the fourth (Turn) card to display all four community cards, as shown in FIG. 7. The dealer then reveals their "hole" card in the dealer's partial hand. The second portion of the game of the present invention is resolved by applying the second preset ranking order, that is, conventional Poker rankings, to the player's final hands and the dealer's final hand. Each player's final hand comprises the player's partial hand combined with the four community cards. The dealer's final hand consists of the dealer's partial hand combined with the four community cards. Thus, both the players and dealers each have a five-card hand in this embodiment. To win the Poker wager, a player's final hand must outrank the dealer's final hand, and the player's final hand must have a ranking of at least a pair. (Of course, preset criteria other than a simple pair may be imposed to set a minimum player hand ranking to win the Poker wager, such as for example at least a Jack.). Payouts for player wins may be paid according to the following pay table, also depicted in the sample table layout of FIG. 8:

| Player's Final Hand Rank | Payout |
|---|---|
| 1 Pair | 1:1 |
| Two Pair | 2:1 |
| Three of a Kind | 3:1 |
| Straight | 5:1 |
| Flush | 10:1 |
| Full House | 12:1 |
| Four of a Kind | 20:1 |
| Straight Flush | 50:1 |
| Five of a Kind | 200:1 |
| Royal Flush | 1000:1 |

It should be readily apparent that it is within the scope of the invention that the above payout amounts may be adjusted to change the house advantage. As but one further example of alternate payout amounts and alternate preset criteria to win the Poker wager, the following optional payout values may be used:

| Player's Final Hand Rank | Payout |
|---|---|
| Jacks or Better | 1:1 |
| Two Pair | 2:1 |
| Three of a Kind | 3:1 |
| Straight | 5:1 |
| Flush | 6:1 |
| Full House | 10:1 |
| Four of a Kind | 50:1 |
| Straight Flush | 100:1 |
| Royal Flush | 500:1 |

Additionally, bonuses may be added for satisfying further criteria or based on the outcome of other events that may be established from time-to-time by the house.

The gaming methods may be played in a number of different formats such as live action casino table gaming format with a live dealer and real playing cards and chips, or with various automated formats with partial (e.g., wagers only) or complete (wagers, cards, dealer, etc.) automation of the format. The exemplary table layout shown in FIG. 8 is sized to accommodate six players. It should be understood that additional devices, automated or manual systems, such as dealing shoes, shufflers, and tables, may be employed in accordance with the present invention in order to achieve its full implementation.

The number of community cards and cards in the player's partial hand and/or dealer's partial hand may vary. The first and second preset ranking orders and preset criteria may also relate to a plurality of other games or outcome conditions that affect the player's hand.

Those skilled in the art will readily appreciate that the methods described above may be incorporated in a system in accordance with the present invention. The system of the present invention may include various computer and network related software and hardware, such as programs, operating systems, memory storage devices, input/output devices, processors, servers with links to data communication systems, wireless or otherwise, and data transceiving terminals. Those skilled in the art will further appreciate that the precise types of software and hardware used are not vital to the full implementation of the present invention so long as players and operators are provided with useful access thereto.

Another variation of the game method can be played as follows. A player places an initial wager to participate in the game, which may be referred to for purposes of discussion as the "Poker" wager. The Poker wager allows the player to play a five card poker hand against the dealer, based on the traditional ranking of poker hands. The five cards are composed of a single card given to the player (and likewise a single card each other player), and the four community cards—three Flop cards and one Turn card. The dealer is also dealt one card, known as the Hole card. Players may place an optional second side wager, termed for purposes of description "Beat the Hole," before any cards are dealt to the player(s) or the dealer. In this instance, the Poker wager allows the player to participate in a Hold'Em style aspect of the game method, whereas the Beat The Hole wager allows the player to compare their single card against the dealer's Hole card.

In the modified Hold'Em game, the dealer's Hole card is dealt face down. If the player's card has a higher point value (based on traditional ranking of cards described above) than the dealer's Hole card, the player is paid at a predetermined ratio based on the Beat the Hole wager which, for purposes of illustration, may be a 1:1 ratio. As such, if the player is dealt a ten value card, and the dealer's Hole card revealed is a six value card, the player would win the Beat the Hole wager at the suggested ratio of 1:1. In the event the dealer and the player are dealt a card with the same numerical rank, then the Beat the Hole wager may be returned to the player. The Beat the Hole wager may be any amount up to or equal to the Poker wager but preferably does not exceed the Poker wager. For example, if the player bets $5 on the Poker wager, the maximum they would be permitted to bet on the Beat the Hole wager is $5. Of course, the house or game proprietor may establish different wagering rules.

To begin play of this modified version of the game method, each player places the Poker wager, and optionally can also place the Beat the Hole wager. At this point, the dealer deals one card face up to each player, and then one card face down to themselves. Then the dealer places three cards face down in a designated spot on the table which represent the traditional Flop in the conventional game of Hold'Em. The Flop cards may be placed linearly on the playing surface, with the first Flop card on the dealer's left, the second Flop card in the center, and the third Flop card on the dealer's right.

The dealer then reveals the first Flop card. At this point the player can view the exposed card and decide if they would like to make an optional side wager which, for purposes of discussion may be called the "Raise" wager. The Raise wager allows player to receive a bonus if they receive a predetermined poker hand ranking. For example, the game rules may be established so that, in order to win the Raise wager, a player must receive a hand of three of a kind or better, in addition to beating the dealer as per the conventional rules of Hold'Em. As such if a player's card and the first Flop card are of equal rank, the player may "Raise" by placing a wager of any amount as long it does not exceed the original Poker wager. According to this example, Raise wagers will be paid if the player makes a hand of three of a kind or better. The Poker wager and the Raise wager may be paid on the same payout scale, or on different payout scales.

At this point in the course of game play, each player may place another optional wager which can for illustrative purposes be called a "Pair Please" wager. Depending on the rules of the individual casino or game proprietor, the Pair Please wager may be required to be placed at the outset of the game before any cards are dealt. The Pair Please wager refers to the four community cards composed of the three Flop cards and the single Turn card. Players will win the Pair Please wager if the four community cards contain a pair or any higher ranked hand. Players do not have to beat the dealer to win the Pair Please wager, and any pair would win. Winning hands would be paid against a pay table and hands greater than a pair, for example two pair, a straight, flush, or other ranked poker hands, would be paid at predetermined ratios against a pay scale.

After the Pair Please and Raise wagers are placed, the dealer reveals the remaining two Flop cards and the Turn card. The four community cards are now exposed and the dealer will pay out winning wagers as per the established rules of the Pair Please wager.

Finally, the dealer will reveal their unexposed Hole card. At this point the dealer will pay out all remaining wagers which would include the Poker wager, the Raise wager when placed by the player, and the Beat the Hole wager when placed by the player.

The Poker wager and the Raise wager may be paid under the same rules of the preferred embodiment game method. Players will win on any pair however their hand must beat the dealers. Players will win the Beat the Hole bet if their single card is of higher rank value than the dealer's Hole card and will be paid at a suggested ratio of 1:1. The Beat the Hole and the Poker wager are paid and played independently, and the outcome of each wager will be independent of the other. After all wagers are paid the round is completed. The dealer may collect the cards and then begin a new round with players at the table.

Referring again to FIG. 7, and ignoring the indications of LOSE-LOSE-WIN for Players 1, 2 and 3 respectively, a game played according to this modified version of the rules would be resolved as follows. For Player 1, the first Bet the Hole portion of their wager (if made) would be resolved in favor of the dealer because the rank of the dealer's Hole card (King) is greater than the rank of the player's card (Four). The second Raise portion of the player's wager (if made) would be resolved in favor of the dealer because the player's card combined with the four community cards does not form a predetermined poker hand ranking, which for purposes of this example requires three-of-a-kind or better. The third Pair Please portion of the player's wager (if made) would be resolved in favor of the player because there is a pair of sevens showing among the player's card combined with the four community cards. The fourth Poker portion of the player's wager would be resolved in favor of the dealer because the player's card combined with the four community cards (pair of Sevens) does not form a better hand than formed with the dealer's Hole card combined with the four community cards (pair of Kings) according to the traditional rules of Poker.

For Player 2, the first Bet the Hole portion of their wager (if made) would be resolved in favor of neither the dealer nor the player (i.e., a Push) because the rank of the dealer's Hole card (King) is equal to the rank of the player's card (Ten). The second Raise portion of the player's wager (if made) would be resolved in favor of the dealer because the player's card combined with the four community cards does not form a predetermined poker hand ranking, which for purposes of this example requires three-of-a-kind or better. The third Pair Please portion of the player's wager (if made) would be resolved in favor of the player because there is a pair of sevens showing among the player's card combined with the four community cards. The fourth Poker portion of the player's wager would be resolved in favor of the dealer because the player's card combined with the four community cards (pair of Sevens) does not form a better hand than formed with the dealer's Hole card combined with the four community cards (pair of Kings) according to the traditional rules of Poker.

For Player 3, the first Bet the Hole portion of their wager (if made) would be resolved in favor of the dealer because the rank of the dealer's Hole card (King) is greater than the rank of the player's card (Seven). The second Raise portion of the player's wager (if made) would be resolved in favor of the player because the player's card combined with the four community cards (three Sevens) forms a predetermined poker hand ranking, which for purposes of this example requires three-of-a-kind or better. The third Pair Please portion of the player's wager (if made) would be resolved in favor of the player because there is at least a pair of sevens showing among the player's card combined with the four community cards. The fourth Poker portion of the player's wager would be resolved in favor of the player because the player's card combined with the four community cards (three Sevens) forms a better hand than formed with the dealer's Hole card combined with the four community cards (pair of Kings) according to the traditional rules of Poker.

While exemplary methods and applications of the methods of the present disclosure have been described, it should also be understood that the foregoing is only illustrative of a few particular embodiments with exemplary and/or preferred features, as well as principles of the present invention, and that various modifications can be made by those skilled in the art without departing from the scope and spirit of the invention. Therefore, the described embodiments should not be considered as limiting of the present invention in any way. Accordingly, the present invention embraces alternatives, modifications and variations which fall within the spirit and scope of the present invention as described herein. Variations and modifications to the disclosed embodiment may become apparent to those skilled in the art and fall within the scope of the invention.

What is claimed is:

1. A method of playing a wagering game through an electronic gaming machine configured to display images of playing cards, said method comprising the steps of:

providing a non-transitory computer readable medium coded with instructions and executed by a processor to perform the steps of:

providing at least one standard deck of 52 playing cards with faces designated in ascending rank 2-10, J, Q, K, A each in four suits;

receiving a multi-portioned wager from the player;

dealing the player one card from the deck to form a player card;

dealing the game machine one card from the deck to form a dealer card;

dealing first, second, third and fourth community cards;

resolving a first portion of the wager in favor of the dealer if the rank of the first community card is greater than the rank of the player card, and in favor of the player if the rank of the first community card is less than the rank of the player card;

resolving a second portion of the wager in favor of the dealer if the rank of the second community card is greater than the rank of the player card, and in favor of the player if the rank of the second community card is less than the rank of the player card, and in favor of neither if the rank of the second community card is equal to the rank of the player card;

resolving a third portion of the wager in favor of the dealer if the rank of the third community card is greater than the rank of the player card, and in favor of the player if the rank of the third community card is less than the rank of the player card, and in favor of neither if the rank of the third community card is equal to the rank of the player card; and resolving a fourth portion of the wager in favor of the dealer if the dealer card combined with the four community cards form a better hand than formed with the player card combined with the four community cards according to the traditional rules of Poker, and in favor of the player if the player card combined with the four community cards form a better hand than formed with the dealer card combined with the four community cards according to the traditional rules of Poker.

2. The method of claim 1, wherein said step of providing at least one standard deck of 52 playing cards includes storing machine-readable data on a computer storage device.

3. The method of claim 1, wherein said step of receiving a wager from the player includes receiving a mandatory bet and up to three optional first, second and third bets, said step of resolving a fourth portion of the wager includes resolving the mandatory bet.

4. The method of claim 1, further including providing a computerized display screen, and wherein said dealing steps include forming the image of a playing card on the display screen.

5. The method of claim 4, wherein said step of resolving a first portion of the wager includes resolving the optional first bet.

6. The method of claim 4, wherein said step of resolving a second portion of the wager includes resolving the optional second bet.

7. The method of claim 4, wherein said step of resolving a third portion of the wager includes resolving the optional third bet.

8. The method of claim 1, wherein said step of dealing first, second, third and fourth community cards includes dealing the fourth community card following said steps of resolving the first, second and third portions.

9. The method of claim 1, wherein said step of dealing first, second, third, and fourth community cards includes dealing the first, second, third, and fourth community cards face down.

10. The method of claim 1, wherein said step of resolving a first portion of the wager further includes resolving the first portion in favor of neither dealer nor player if the rank of the first community card is equal to the rank of the player card.

11. The method of claim 1, wherein said step of resolving a second portion of the wager further includes resolving the second portion in favor of neither dealer nor player if the rank of the second community card is equal to the rank of the player card.

12. The method of claim 1, wherein said step of resolving a third portion of the wager further includes resolving the third portion in favor of neither dealer nor player if the rank of the third community card is equal to the rank of the player card.

13. The method of claim 1, wherein said step of resolving a fourth portion of the wager further includes resolving the fourth portion in favor of neither if the dealer card combined with the four community cards forms an equivalent hand to that formed with the player card combined with the four community cards according to the traditional rules of Poker.

14. The method of claim 1, further including resolving a Raise portion of the player's wager in favor of the player if the four community cards form a predetermined poker hand ranking.

15. The method of claim 1, wherein said step of resolving a fourth portion of the wager further includes forfeiting a percentage of the fourth portion if the player decides to Fold their hand.

16. A method for playing a card game combining elements of the traditional games of Poker and War between a computerized dealer and at least one player, said method comprising the steps of:

providing a non-transitory computer readable medium coded with instructions and executed by a processor to perform the steps of:

providing at least one standard deck of 52 playing cards with faces designated in ascending rank 2-10, J, Q, K, A each in four suits;

receiving a multi-portioned wager from each player;

dealing each player one card to form a respective player card;

dealing the game machine dealer one card to form a dealer card;

dealing first, second, third and fourth community cards;

and for respective player:

resolving a first Bet the Hole portion of the player's wager in favor of the dealer if the rank of the dealer card is greater than the rank of the player's card, and in favor of that player if the rank of the dealer card is less than the rank of the player's card, and in favor of neither if the rank of the dealer card is equal to the rank of the player's card;

resolving a second Raise portion of the player's wager in favor of the player if the player's card combined with the four community cards form a predetermined poker hand ranking;

resolving a third Pair Please portion of the player's wager in favor of the player if the four community cards form at least a pair according to the traditional rules of Poker; and resolving a fourth Poker portion of the player's wager in favor of the player if the player's card combined with the four community cards form a better hand than formed with the dealer card combined with the four community cards according to the traditional rules of Poker.

17. The method of claim 16, wherein said step of receiving a multi-portion wager from each player includes restricting the amounts of the first Bet the Hole portion, second Raise portion, and third Pair Please portion to a mathematical factor of the fourth Poker portion.

18. The method of claim 17, wherein said step of restricting the amounts of the first Bet the Hole portion, second Raise portion, and third Pair Please portion includes not exceeding the amount of the fourth Poker portion.

19. The method of claim 16, wherein said step of dealing first, second, third and fourth community cards includes dealing the first, second, third, and fourth community cards face down.

20. The method of claim 16, wherein said step of resolving the second Raise portion includes requiring the predetermined poker band ranking to comprise three of a kind or better according to the traditional rules of Poker.

* * * * *